United States Patent [19]

Breitbach

[11] Patent Number: 4,477,019

[45] Date of Patent: Oct. 16, 1984

[54] FLUE GAS HEAT RECOVERY APPARATUS FOR A FORCED AIR HOME HEATING SYSTEM

[76] Inventor: Johnnie J. Breitbach, 2513 Yorktown Dr., Bloomington, Ill. 61071

[21] Appl. No.: 529,366

[22] Filed: Sep. 6, 1983

[51] Int. Cl.[3] ..... F28F 1/10; F24B 7/00

[52] U.S. Cl. ..... 236/10; 237/55; 431/20; 165/DIG. 2

[58] Field of Search ..... 237/50, 51, 55; 236/10, 236/11; 431/20; 165/DIG. 2

[56] References Cited

U.S. PATENT DOCUMENTS

| | | | |
|---|---|---|---|
| 2,286,296 | 6/1942 | McGrath | 236/11 |
| 4,103,735 | 8/1978 | Warner | 237/55 |
| 4,111,357 | 9/1978 | Mieczkowski | 236/11 |
| 4,176,787 | 12/1979 | Gary | 237/55 |

FOREIGN PATENT DOCUMENTS

| | | | |
|---|---|---|---|
| 2499216 | 8/1982 | France | 431/20 |

*Primary Examiner*—Henry Bennett
*Attorney, Agent, or Firm*—Vernon J. Pillote

[57] ABSTRACT

A flue gas heat recovery apparatus for a forced air type furnace of the type having a furnace heat exchanger, a return air duct and a heated air duct, and a blower for passing air from the return air duct over the furnace heat exchanger to the heated air duct. The heat recovery apparatus includes a secondary heat exchanger mounted in the return air duct having its inlet connected to the outlet of the furnace heat exchanger and an induced draft fan having its inlet connected to the outlet of the secondary heat exchanger and its outlet connected through an outlet flue pipe to the chimney. A vane is mounted in the outlet flue pipe in the path of flow from the induced draft fan and is moved between a closed position when the fan is not operating, to an open position when the fan is operating, and a switch is operated by the vane to operate the burner control after the induced draft is in operation.

6 Claims, 7 Drawing Figures

Fig. 3.
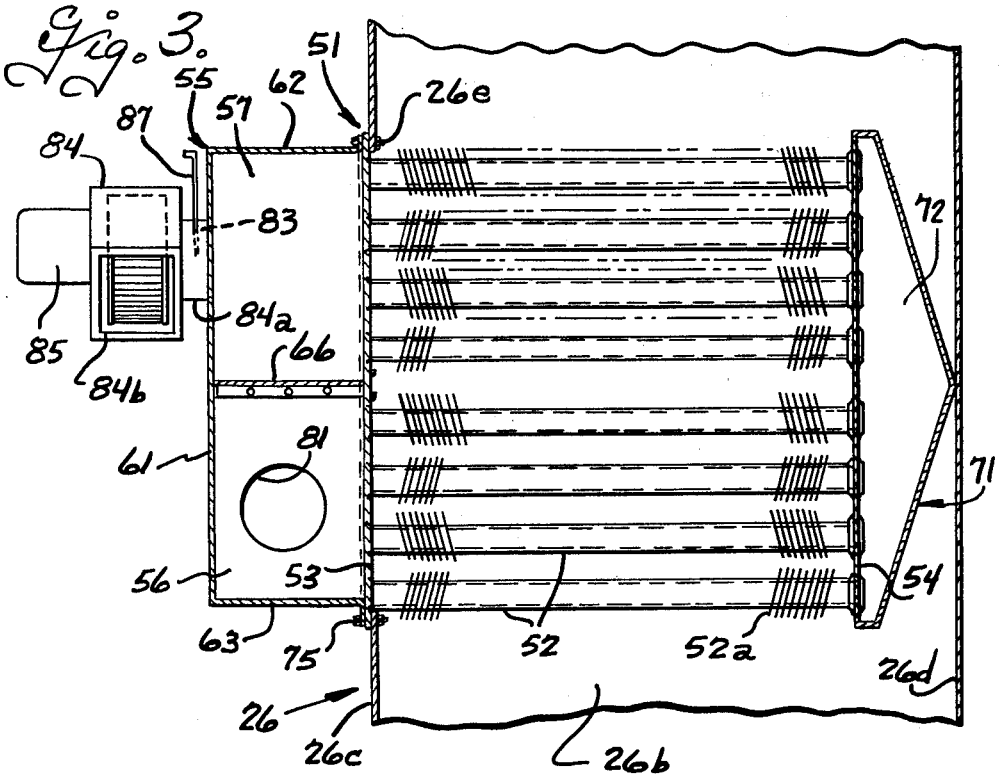
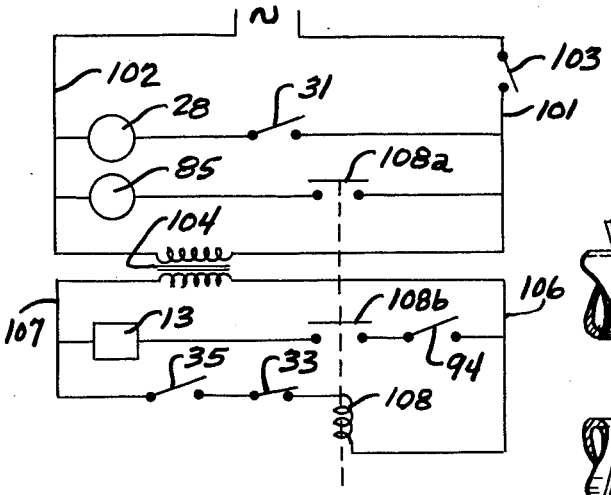
Fig. 2.
Fig. 4.
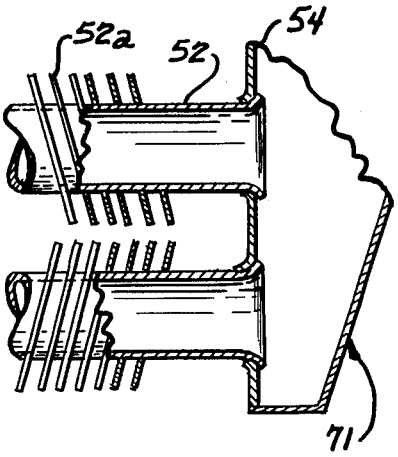

FLUE GAS HEAT RECOVERY APPARATUS FOR A FORCED AIR HOME HEATING SYSTEM

BACKGROUND OF THE INVENTION

Many forced air heating furnaces now in use are of the type in which the hot flue gases from the furnace heat exchanger are vented through a draft diverter and flue pipe to a chimney. The temperature of the flue gases from the furnace are usually relatively high, of the order of 450 degrees to 500 degrees F., and a large amount of heat in the flue gases is lost. Further, the draft diverter and flue system of the furnace draws air from the furnace room, even when the furnace burner is shut off, so that there is a continuing loss of warm air from the furnace room.

Various different apparatus have heretofore been proposed for recovering heat from the flue gases and reducing heat loss due to venting of furnace room air to the chimney when the furnace burner is shut off. However, there remains a need for a flue gas heat recovery apparatus which can be installed in the return air duct and flue pipe of an existing forced air heating system, to preheat the return air by the furnace flue gases and control venting of the furnace room air when the furnace burner is shut off, in a safe, reliable and efficient manner.

SUMMARY OF THE INVENTION

Accordingly, the present invention provides a flue gas heat recovery apparatus for a forced air home heating system of the type which includes a furnace having a combustion chamber and a burner in the combustion chamber, a furnace heat exchanger, a return air duct and a heated air duct and a furnace fan for blowing air from the return air duct past the furnace heat exchanger to the heated air duct, with burner control means for controlling operation of the burner and a room thermostat responsive to the temperature of the space to be heated. The heat recovery apparatus comprises a secondary heat exchange unit adapted for installation through an opening in one side of the return air duct to extend crosswise of the duct and into the path of air flow, the heat exchange unit having a secondary flue gas inlet and a flue gas inlet pipe for connecting the secondary flue gas inlet to the furnace flue gas outlet of the furnace heat exchanger, and the secondary heat exchange unit also has a secondary flue gas outlet. An induced draft fan has its inlet connected to the secondary flue gas outlet of the secondary heat exchanger and a fan outlet connected to an outlet flue pipe. A vane is mounted in the outlet flue pipe for pivotal movement about an axis crosswise of the outlet flue pipe between a closed position extending crosswise of the outlet flue pipe and an open position. The vane is yieldably biased to its closed position substantially blocking flow through the outlet flue pipe and the pivot axis of the vane is offset from the center of the face area such that it is moved to its open position by the air flow in the outlet pipe from the induced draft fan when the latter is operating. Means actuated by the thermostat is provided for operating the induced draft fan, and means is provided for operating the burner control in response to movement of the vane to its open position.

With the above apparatus, the vane is not operated to turn the burner on until after the induced draft fan is in operation. This assures proper venting of the combustion chamber and further assures that the burner will not be turned on if the induced draft fan fails to operate for any reason. Further, when the thermostat turns the induced draft fan off, the vane moves to its closed position to both shut off the burner and shut off the flow of furnace room air through the flue pipe. The induced draft fan not only assures a controlled and adequate flow of air through the combustion chamber and reliable venting of the flue gases, but also reduces the flue gas pressure in the furnace and secondary heat exchangers to effectively preclude leakage of flue gases from the heat exchangers into the air being heated during operation of the furnace.

An adjustable draft control damper is advantageously provided at the inlet of the induced draft fan for controlling the flow of air to the induced draft fan and hence the flow of air into the combustion chamber.

The secondary heat exchanger is advantageously arranged so that secondary the flue gas inlet and the flue gas outlet are at the same end of the heat exchanger, to simplify installation of the heat exchanger into the return air duct and also simplify connection of the secondary flue gas inlet and outlet to the existing furnace and chimney.

BRIEF DESCRIPTION OF THE DRAWINGS

FIG. 2 is a schematic electrical diagram of the electrical controls for the apparatus of FIG. 1;

FIG. 3 is a fragmentary transverse sectional view taken on the plane 3—3 of FIG. 1 and illustrating the heat exchanger mounted in the return air duct;

FIG. 4 is a fragmentary sectional view through the heat exchanger on a larger scale than FIG. 3;

FIG. 1 diagrammatically illustrates a forced air type furnace having a combustion chamber 10 with an air inlet 10*a* and a burner 11 in the combustion chamber. The furnace herein shown is of a gas fired type and the burner 11 is connected through a gas infeed pipe 12 and burner control 13 to a gas supply pipe 14. The furnace has a furnace heat exchanger 15 with its hot gas inlet 16 communicating with the combustion chamber for receiving hot gases therefrom, and a flue gas outlet 17 for passing hot flue gases from the furnace heat exchanger. The furnace includes housing 21 having a lower cold air inlet 22 and a upper heated air outlet 23 and, as is conventional, the heated air outlet 23 is connected through a heated air plenum chamber 24 to the heated air duct system 25 of the home. The cold air inlet 22 is connected to a cold air return duct 26, and a furnace fan or blower 27 driven by a motor 28 is provided for blowing air from the return air duct past the furnace heat exchanger to the heated air plenum chamber 24 and heated air duct system 25. An air filter 30 is commonly provided in the return air duct. As is also conventional, a blower control switch 31 is provided with a temperature sensor 32 for sensing the temperature of the air adjacent the heated air outlet of the furnace, which blower control switch is operative to turn the blower on when the furnace air temperature is above a preselected upper limit, and operative to turn the blower motor off when the furnace air temperature drops below a preselected lower limit, which lower limit is usually set a number of degrees below the upper limit to reduce cycling of the blower motor on and off. The furnaces also commonly have a high temperature limit switch 33 which senses the temperature of the furnace and which is operated to a closed position at a temperature substantially above the upper temperature limit of the blower control switch 31. The high temperature limit switch is provided to shut off the burner, in the event the temperature rises above an upper "safe" limit and may be incorporated in the burner control switch. Operation of the furnace is controlled by a room thermostat 35 located at a convenient location in the space to be heated. In the conventional forced air furnace system, the flue gas outlet 17 of the furnace heat exchanger is connected through a draft diverter (not shown) and a flue pipe to a chimney or vent 36. The temperature of the flue gases at the outlet 17 of the furnace heat exchanger are usually quite high, frequently of the order of 450 to 500 degrees F. and, in the conventional furnace. All of the heat in the flue gases is lost up the chimney or vent 36. In addition, the draft diverter opens to the furnace room and, when the furnace is operating, air from the furnace room flows in through the draft diverter and through the flue pipe to the chimney so that some of the warm air in the furnace room is also lost. When the furnace is shut off, air from the furnace room can still pass through the draft diverter to the chimney and can also pass from the furnace room through the air inlet 10*a* of the combustion chamber 10 through the furnace heat exchanger and through the and flue pipe to the chimney. There is, accordingly, a substantial loss of warm air from the furnace room, even when the furnace is shut off.

Figure 1:
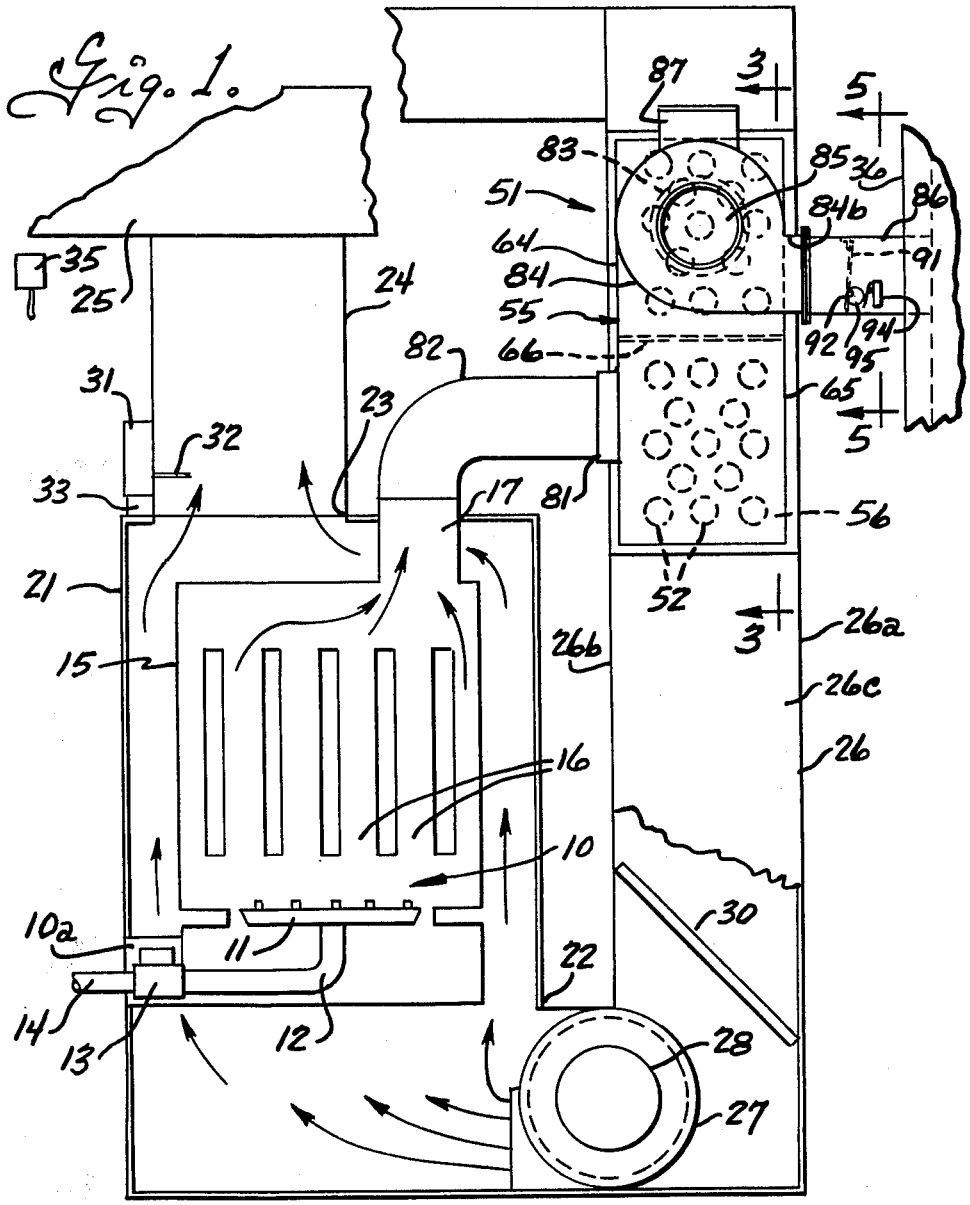
FIG. 1 is a diagrammatic view of a forced air home heating system having the heat recovery apparatus of the present invention installed therein.

The present invention is directed to a flue gas heat recovery apparatus for the furnace and is arranged to recover a substantial part of the heat from the flue gases, and to also stop venting of warm air from the furnace room to the chimney, when the furnace burner is shut off. The heat recovery conversion apparatus includes a secondary heat exchanger designated generally by the numeral 51 that is adapted to be mounted in the return air duct 26. The furnace return air ducts are commonly of rectangular cross section and include a first pair of spaced side walls 26*a*, 26*b* and a second pair of spaced side walls 26*c*, 26*d* that extend between the side walls 26*a* and 26*b*. The heat exchanger preferably is of the multiple tube type to provide a large heat transfer surface and the flue gas inlet and outlet of the secondary heat exchanger are advantageously located at the same end of the heat exchanger, to facilitate installation of the heat exchanger in the return air duct and also facilitate connection of the heat exchanger to the flue pipes. The heat exchanger comprises a plurality of tubes 52 that extend through openings in headers 53 and 54, and are sealed thereto as by brazing. A casing 55 is attached to one of the headers 53 to provide a flue gas inlet chamber 56 that communicates with one end of the first group of the heat exchange tubes 52, and a flue gas outlet chamber 57 that communicates with one end of a second group of the heat exchange tubes 52. In the embodiment shown, the casing 55 is of generally rectangular configuration and has an ene wall 61, top and bottom walls 62 and 63, and spaced side walls 64 and 65 that extend between the top and bottom walls. A divider wall 66 is disposed between the side walls 64 and 65 and separates the casing 55 into the aforementioned flue gas inlet chamber 56 and flue gas outlet chamber 57. The casing is attached to the header 53 in sealed relation therewith and may, for example, be welded or brazed around the periphery of the header 53. A flue gas return casing 71 is attached in sealed relation, as by brazing to the header 54 to define a flue gas return chamber 72 that communicates with the other ends of all of the tubes 52.

The heat exchanger is arranged to be mounted through an opening 26*e* that is cut into one side 26*c* of the return air duct. The heat exchange tubes extend crosswise of the return air duct, with the return casing 71 and return chamber 72 inside the duct, and with the casing 55 and inlet chamber 56 and outlet chamber 57 located externally of the return air duct. The heat exchanger is secured around the periphery of the casing 55 to the return air duct as by fasteners 75 in a manner to form a seal between the return air duct and the adjacent portions of the heat exchange casing 55. The heat exchange tubes 52 are preferably provided with transversely extending heat exchange fins 52*a* therealong to improve heat exchange between the tubes and the air in the return air duct.

The casing 55 has a flue gas inlet opening 81 that communicates with the flue gas inlet chamber 56 at one side of the heat exchanger, and which is connected through a flue pipe 82 to the flue gas outlet 17 of the furnace heat exchanger. Casing 55 has a flue gas outlet 83 and an induced draft fan 84, conveniently of the centrifugal or squirrel cage blower type, is mounted on the casing 55 with its inlet 84*a* in communication with the flue gas outlet 83. The induced draft fan 84 is driven by a motor 85 and has an outlet 84*b* that is connected through a flue gas outlet pipe 86 to the chimney 36 or other flue gas vent pipe. A manually adjustable damper 87 is advantageously provided at the inlet 84*a* of the induced draft fan 84 and is adjustable crosswise of the inlet opening to adjust the rate of flow of air therethrough. The damper 84*a* may, for example, comprise a blade like member which is slidable through a slot in the casing of the induced draft fans to adjustably throttle the inlet of the fan with suitable means being provided for retaining the damper in its adjusted position.

Figure 5:
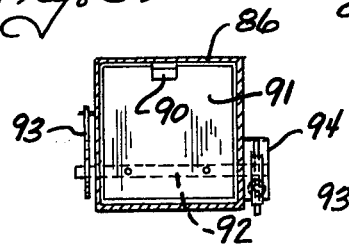
FIG. 5 is a transverse sectional view through the outlet flue pipe taken on the plane 5—5 of FIG. 1.
Figure 6:
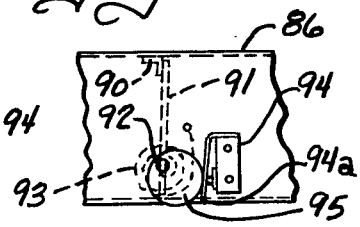
FIGS. 6 and 7 are fragmentary views illustrating the flue pipe vane in different moved positions.
Figure 7:
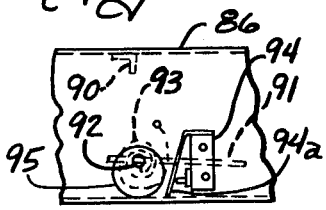

The heat recovery apparatus also includes a vane 91 mounted in the flue gas outlet pipe 86 for pivotal movement about the axis of a shaft 92 crosswise of the outlet pipe between a closed position as shown in FIGS. 5 and 6 and an open position as shown in FIG. 7. The vane 91 is yieldably biased to a closed position against a stop flange 90 as shown in FIG. 6, as by a spring 93 or a suitable counterweight, and the shaft 92 is offset from the center of the area of the vane so that the vane will be moved to its open position shown in FIG. 7 in response to air flow from the induced draft fan. The vane 91 is arranged to operate a switch 94 and, as shown, has a cam 95 arranged to engage the switch actuator 94*a*. The switch 94 and the cam 95 are arranged so that the switch 94 is open when the vane is in its closed position, and closed when the vane is in its open position.

The electrical circuit for the furnace and heat recovery apparatus is shown in FIG. 2. The circuit includes conductors 101 and 102 connected through a manual on/off switch 103 to a standard 110 volt power supply. The furnace motor 28 is connected in series with the blower control switch 31, across conductors 101 and 102, so that the blower motor is turned on when the temperature sensed by the burner control switch 31 reaches a preselected upper limit, and the blower motor is turned off when the temperature sensed by the switch 31 reaches a preselected lower limit. Conductors 101 and 102 are connected through a transformer 104 to a low voltage circuit including conductors 106 and 107. A relay 108 is connected in a series circuit with the high temperature limit switch 33 and room thermostat 35 across conductors 106 and 107. High temperature limit switch 33 is closed, except when the furnace temperature exceeds an upper or safe limit, so that operating the relay 108 is normally controlled by thermostat 35. Room thermostat 35 closes when the temperature drops below the thermostat setting to thereby actuate relay 108. Relay 108 operates relay switches **108*a* and 108*b* which are normally open and which are closed when the relay is energized. The motor 85 of the induced draft fan is connected in a series circuit with relay switch 108*a* across conductors 101 and 102 so that the induced draft fan 84 is operated when the room thermostat 35 closes and operates the relay 108. The burner control 13 is connected in a series circuit with relay switch 108*b* and vane operated switch 94 across conductors 106 and 107. Vane switch 94 is normally open and is closed when the air flow from the induced draft fan 84 moves the vane 91 to its open position as shown in FIG. 7. Thus, the burner control 13 is not energized until after the induced draft fan has been turned on and comes up to a speed sufficient to operate the vane 91 to its open position. The burner control 13 can be of the type used in furnaces having a constantly burning pilot, in which event the burner control comprises a main gas valve which is energized to its open position when a circuit is completed to the burner control. The burner control can also be of the electrically ignition type having an electrical igniter for igniting a pilot, and internal controls in the burner control for operating the main gas valve after the pilot has been ignited. In such electrical ignition systems, the igniter is operated when the switch 94 closes to establish a circuit to the burner control 13**. Such constant pilot type burner controls and electrical ignition type burner controls are well known in the art and detailed description is deemed unnecessary.

From the foregoing it is thought that the construction, installation and operation of the flue gas recovery apparatus in a forced air heating furnace, will be readily understood. In order to install the heat recovery conversion apparatus, it is only necessary to cut an opening **26*e* in the side of the return air duct and insert the heat exchange unit into the duct and secure the same to the duct around the opening. The flue pipe and draft diverter that are normally installed between the outlet of the furnace and the chimney are first removed. The inlet of the heat exchanger is connected through a flue gas pipe 82 to the outlet 17 of the furnace heat exchanger, and the outlet of the induced draft fan 84 is connected through a flue outlet pipe 86 to the chimney or other flue gas vent. Since the inlet and an outlet of the heat exchanger are located at the same end of the heat exchanger, the flue pipes 82 and 86 can usually be reconnected to the furnace and chimney in the same area in which the original flue pipe was located. The motor 28 for the furnace fan or blower and the blower control switch 31 are those which are provided on the conventional furnace and their electrical connection and operation remains the same. The induced draft fan 85, vane switch 94 and relay 108 are added and are connected in the circuit as shown in FIG. 2. The relay 108 is energized when the room thermostat closes indicating a demand for heat, and relay 108, when energized, closes relay switches 108*a* and 108*b*. Closing of switch 108*a* starts the motor 85 of the induced draft fan 84 and this starts the flow of air through the combustion chamber and furnace heat exchanger to vent any residual gases therein. When the induced draft fan reaches a certain speed, the flue gases discharged by the fan operate vane 91 to its open position and this operates switch 94 to its closed position. Closing the switch 94 operates the burner control 13. Thus, the burner control is not turned on until after the induced draft fan has been turned on and comes up to a minimum speed. This not only assures the proper venting of the combustion chamber and furnace heat exchanger before the burner control is operated, but also assures that the burner control will not be operated if the induced draft fan fails to operate for any reason. The induced draft fan, when operating, draws air into the combustion chamber through intake 10*a* and moves the hot gases and combustion products through the furnace heat exchanger and secondary heat exchanger at a controlled flow rate determined by the setting of the adjustable damper 87. Thus, the rate of flow of air into the combustion chamber can be accurately preset to provide adequate secondary air for proper combustion of the fuel at the burner 11, without drawing excessive air from the furnace room. When the room thermostat opens indicating that the space to be heated has come up to the desired temperature, relay 108 is de-energized and relay switches 108*a* and 108*b* return to their open position. Opening of relay switch 108*a* de-energizes the motor of the induced draft fan and opening of relay switch 108*b* de-energizes the burner control. The inertia of the induced draft fan and motor will normally cause it to continue rotating for a short time interval after the motor 85 is de-energized, to thereby exhaust combustion products from the furnace heat exchanger. If desired, a time delay relay can be provided to maintain a circuit to the induced draft fan for a short time interval after deenergizing of relay 108**, to assure that the induced draft fan will exhaust the combustion product from the furnace heat exchanger.

The embodiments of the invention in which an exclusive property or privilege is claimed are defined as follows:

1. In a forced air home heating system of the type which includes a furnace having a combustion chamber and burner means in the combustion chamber, a furnace heat exchanger having a hot gas inlet communicating with the combustion chamber for receiving hot gases therefrom and a furnace flue gas outlet, a return air duct means and a heated air duct means and furnace fan means for blowing air from the return air duct means past the primary heat exchanger to the heated air duct means, burner control means for controlling operation of the burner means, and thermostat means responsive to the temperature of the space to be heated, a heat recovery apparatus comprising a secondary heat exchange unit extending through an opening in one side of the return air duct means to extend crosswise thereof into the path of air flow therethrough, the secondary heat exchange unit including a secondary flue gas inlet chamber located at one side of the return air duct means and having a secondary flue gas inlet therein, the secondary heat exchange unit having a secondary flue gas outlet chamber located at said one side of the return air duct means and adjacent said secondary flue gas inlet chamber and having secondary flue gas outlet therein, a first group of heat exchange tubes communicating at a first end with a secondary flue gas inlet chamber and extending crosswise of the return air duct means, a second group of heat exchange tubes communicating at a first end with the secondary flue gas outlet chamber and extending crosswise of the return air duct means at a level above the first group of heat exchange tubes, means in the secondary heat exchange unit for passing flue gases from the first group of heat exchange tubes to the second group of heat exchange tubes at locations spaced from said first ends thereof, inlet flue pipe means connecting the secondary flue gas inlet to the furnace flue gas outlet of the furnace heat exchanger, induced draft fan means having a fan inlet connected to the secondary flue gas outlet of the secondary heat exchange unit and a fan outlet, outlet flue pipe means connected to the fan outlet, vane means mounted in the outlet flue pipe means for pivotal movement about an axis crosswise of the outlet flue pipe means between a closed position extending transverse to the outlet flue pipe means and an open position, the vane means having means yieldably biasing it to its closed position substantially blocking flow through the outlet flue pipe means and the pivot axis of the vane means being offset from the center of its face area such that it is moved to its open position by the air flow in the outlet pipe from said induced draft fan when the latter is operating, means actuated by the thermostat means for operating said induced draft fan means, and vane switch means responsive to movement of said vane means to its open position for operating said burner control means.

2. A forced air home heating system according to claim 1 including adjustable draft control damper means adjacent said fan inlet of the induced draft fan means for controlling the flow of air to the induced draft fan means.

3. A forced air heating system according to claim 1 wherein said secondary heat exchange means includes first and second relatively parallel headers having said first and second groups of heat exchange tubes extending therebetween, said secondary flue gas inlet chamber being attached to a portion of said first header and communicating with said first end of said first group of said heat exchange tubes, said secondary flue gas outlet chamber being attached to a second portion of said first header and communicating with said first end of said second group of said heat exchange tubes, said means for passing flue gases from the first group of tubes to the second group of tubes including a return flue gas chamber disposed inside said return air duct means and attached to said second header for passing flue gases from the first group of tubes to the second group of tubes, means for attaching said first header of the secondary heat exchanger to the return air duect means with the secondary flue gas inlet and outlet chambers disposed outside the return air duct means and with the heat exchange tubes extending crosswise of the return air duct means.

4. A forced air heating system according to claim 1 wherein said induced draft fan is mounted on said secondary flue gas outlet chamber.

5. A forced air heating system according to claim 1 wherein the means for operating the induced draft fan means includes a relay means electrically connected to the thermostat means to be energized when the thermostat means indicates a demand for heat, switch means operated by said relay means and electrically connected to the induced draft fan means for operating the induced draft fan means when the relay means is energized, said vane switch means for operating the burner control means being electrically connected to said relay means and to the burner control means to operate said burner control means only when both said relay means is energized and said vane switch means is operated.

6. In a forced air home heating system of the type which includes a furnace having a combustion chamber and burner means in the combustion chamber, a primary heat exchanger having a primary hot gas inlet communicating with the combustion chamber for receiving hot gases therefrom and a primary flue gas outlet, a return air duct means and a heated air duct means and a furnace fan means for blowing air from the return air duct means past the primary heat exchanger to the heated air duct means, burner control means for controlling operation of the burner means, and thermostat means responsive to the temperature of the space to be heated, a heat recovery apparatus comprising a secondary heat exchange unit extending through an opening in one side of the return air duct means to extend crosswise thereof into the path of air flow therethrough, the secondary heat exchange unit including a secondary flue gas inlet chamber located externally of the return air duct means at one side thereof and having a secondary flue gas inlet therein, the secondary heat exchange unit having a secondary flue gas outlet chamber located externally of the return air duct means at said one side thereof and above said secondary flue gas inlet chamber and having a secondary flue gas outlet therein, a first group of heat exchange tubes communicating at a first end with the secondary flue gas inlet chamber and extending crosswise of the return air duct means, a second group of heat exchange tubes communicating at a first end with the secondary flue gas outlet chamber and extending crosswise of the return air duct means at a level above the first group of heat exchange tubes, means in the secondary heat exchange unit for passing flue gases from the first group of heat exchange tubes to the second group of heat exchange tubes at locations spaced from said first ends thereof, inlet flue pipe means for connecting the secondary flue gas inlet to the furnace flue gas outlet of the furnace heat exchanger, the secondary heat exchange unit having a secondary flue gas outlet, induced draft fan means having a fan inlet connected to the secondary flue gas outlet of the secondary heat exchange unit and a fan outlet, outlet flue pipe means connected to the fan outlet, vane means mounted in the outlet flue pipe means for pivotal movement about an axis crosswise of the outlet flue pipe means between a closed flue position extending transverse to the outlet flue pipe means and an open flue position, the vane means having means yieldably biasing it to its closed position substantially blocking flow through the outlet flue pipe means and the pivot axis of the vane means being offset from the center of its face area such that it is moved to its open position by the air flow in the outlet pipe from said induced draft fan when the latter is operating, relay means electrically connected to said thermostat means to be energized thereby when the thermostat means senses a preselected lower temperature, a first normally open switch means electrically connected to said induced draft fan means and operated by said relay means to its closed position when the relay means is energized to operate said induced draft fan means, a second normally open switch means operated by said relay means to its closed position when the relay means is energized, a vane switch operated by movement of said vane means to its open position when the vane means is in its closed flue position and to its closed position when the vane means is in its open flue position, and means electrically connecting said second switch means and said vane switch to said burner control means for operating the burner control means when the vane means is moved to its open flue position.

* * * * *